US006530105B1

(12) United States Patent
MacDonald

(10) Patent No.: US 6,530,105 B1
(45) Date of Patent: Mar. 11, 2003

(54) SPIKE CLEANER

(76) Inventor: Guy J. MacDonald, 38911 Albert St., Mt. Clemens, MI (US) 48043

( * ) Notice: Subject to any disclaimer, the term of this patent is extended or adjusted under 35 U.S.C. 154(b) by 0 days.

(21) Appl. No.: 09/766,316

(22) Filed: Sep. 26, 2000

Related U.S. Application Data

(63) Continuation of application No. PCT/US00/02296, filed on Jan. 28, 2000.
(60) Provisional application No. 60/117,786, filed on Jan. 29, 1999.

(51) Int. Cl.[7] ..... A46B 15/00; A47L 23/00
(52) U.S. Cl. ..... 15/161; 15/112; 15/237; 280/164.2
(58) Field of Search ..... 15/112, 161, 215–217, 15/237, 238; 280/164.2

(56) References Cited

U.S. PATENT DOCUMENTS 3,028,617 A * 4/1962 Racina ..... 15/161 X
3,142,853 A * 8/1964 Hensley ..... 15/161 X
3,740,072 A * 6/1973 Veith ..... 280/164.2
5,075,917 A * 12/1991 Wheat et al. ..... 15/161
5,437,075 A * 8/1995 Peake ..... 15/161
6,032,316 A * 3/2000 Peake et al. ..... 15/161

* cited by examiner

*Primary Examiner*—Mark Spisich
(74) *Attorney, Agent, or Firm*—Plunkett & Cooney, PC; Arnold S. Weintraub, Esq.

(57) ABSTRACT

A golf shoe spike cleaner particularly adapted for use in association with a golf cart comprises a frame for mounting at least one spike cleaner thereto, at least one spike cleaner mounted to the frame, and mounting member for mounting the spike cleaner to the golf cart. The present device may further include a plurality of spike cleaners, angularly disposed with respect to the horizontal or ground at a convenient angle for dragging a golf shoe thereacross. To prevent debris from flying into the golf cart a shield is used to deflect the debris away from the cart.

15 Claims, 3 Drawing Sheets

FIG 1
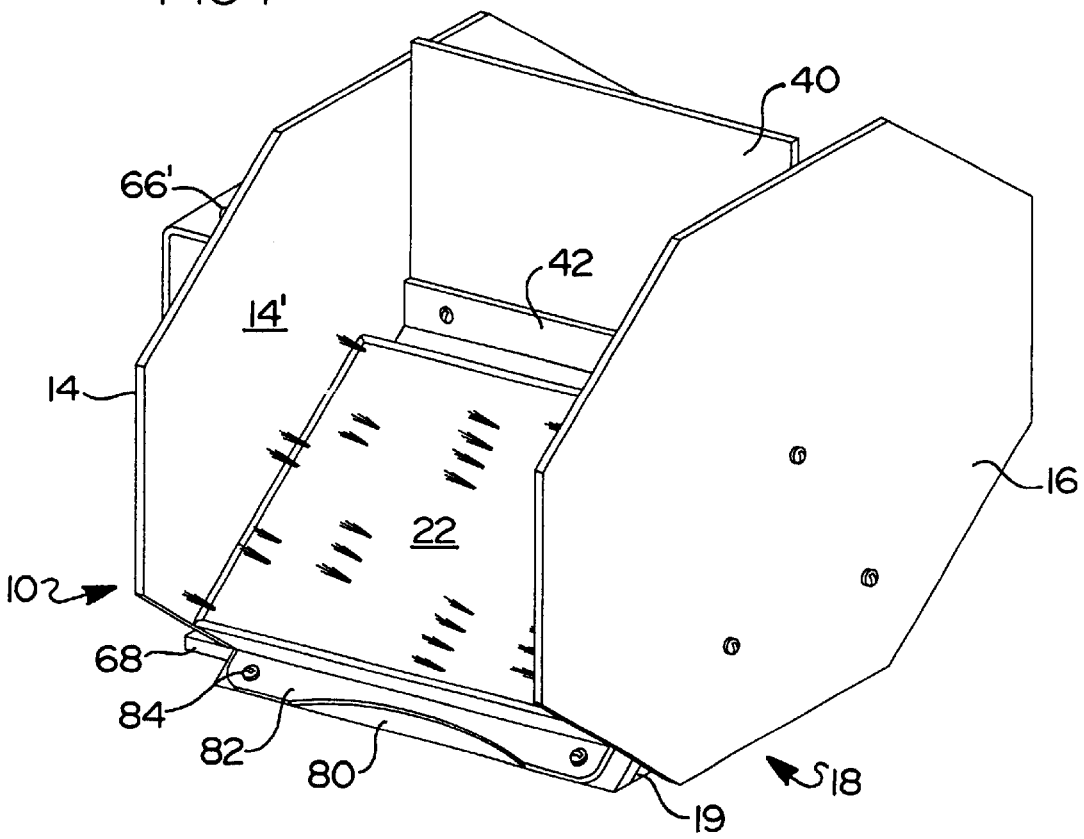
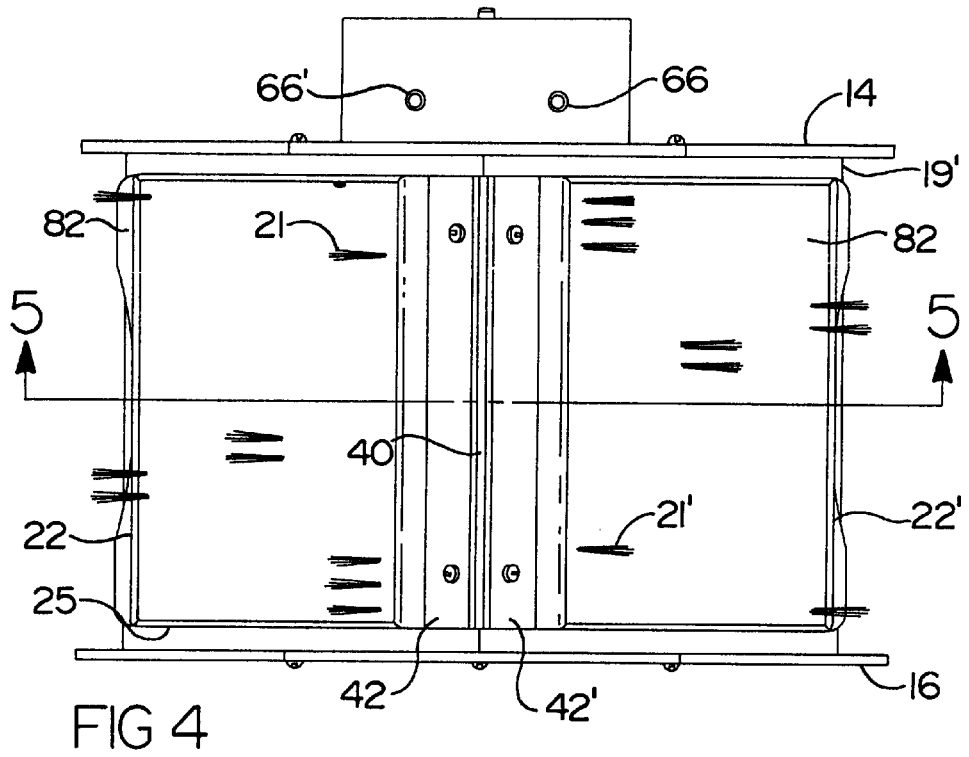
FIG 4

SPIKE CLEANER

This application is a continuation of PCT/US00/02296, filed Jan. 28, 2000 and further claims the benefit of U.S. provisional Application No. 60/117,786, filed Jan. 29, 1999, the disclosure of which is incorporated by reference.

FIELD OF THE INVENTION

The present invention relates to golf equipment. More particularly, the present invention concerns golf shoe spike cleaners. Even more particularly, the present invention concerns vehicular mounted golf shoe spike cleaners.

PRIOR ART

The "spikes" of a golf shoe are elongated pointed shafts, which extend downwardly from the sole of the golf shoe. As is known to those skilled in the art to which the present invention pertains, the cleaning of the "spikes" of golf shoes is a necessary task which must occur during the course of playing a round of golf in order to prevent slippage and obtain the proper footing.

Cleaning is necessitated by grass and other debris caught between the spikes. Usually the debris is removed through brushes, tees or the like. Today, with the advent of "spikeless" shoes cleaning of the soles of the shoes bearing these spikeless spikes becomes more imperative because of the easy loss of traction, especially where the grass is damp and/or recently cut.

Furthermore, and as is known to those skilled in the art to which the present invention pertains, typically, spike cleaners comprise stiff brushes, usually found at the tee box, and which are mounted onto a post thereat. Especially at public golf courses, such spike cleaning brushes are intermittently and sporadically provided around the golf course. Because of the ever Increasing growth of the use of power cars or carts by golfers, the incorporation of a spike cleaner as an accouterment for such a golf cart offers the ability to provide a spike cleaner at all times to the golfer. The benefit to the golfer is, therefore, readily apparent. As is detailed hereinafter, the present invention affords such benefit.

BRIEF SUMMARY OF THE INVENTION

Thus, and in accordance with the present invention, there is provided a golf shoe spike cleaner particularly adapted for use in association with a golf cart and which, generally, comprises:

(a) a frame for mounting at least one spike cleaner, thereto, (b) at least one spike cleaner mounted to the frame, and (c) mounting means for mounting the spike cleaner to a golf cart.

The present device may further include a plurality of spike cleaners, angularly disposed with respect to the horizontal or ground at a convenient angle for dragging a golf shoe thereacross.

In order to prevent debris from flying into the golf cart a shield is used to deflect the debris away from the cart.

The various features, advantages, and other uses of the present invention will become more apparent by referring to the following detailed description and drawings. Throughout the detailed description and drawings, identical reference numbers are used to refer to the same components shown in the multiple figures, in which:

BRIEF DESCRIPTION OF THE DRAWINGS

FIG. 1 is a perspective view of a golf shoe spike cleaner in accordance with the present invention;

FIG. 4 is a top plan view of the spike cleaner shown in FIG. 1;

DESCRIPTION OF THE PREFERRED EMBODIMENT

Figure 2:
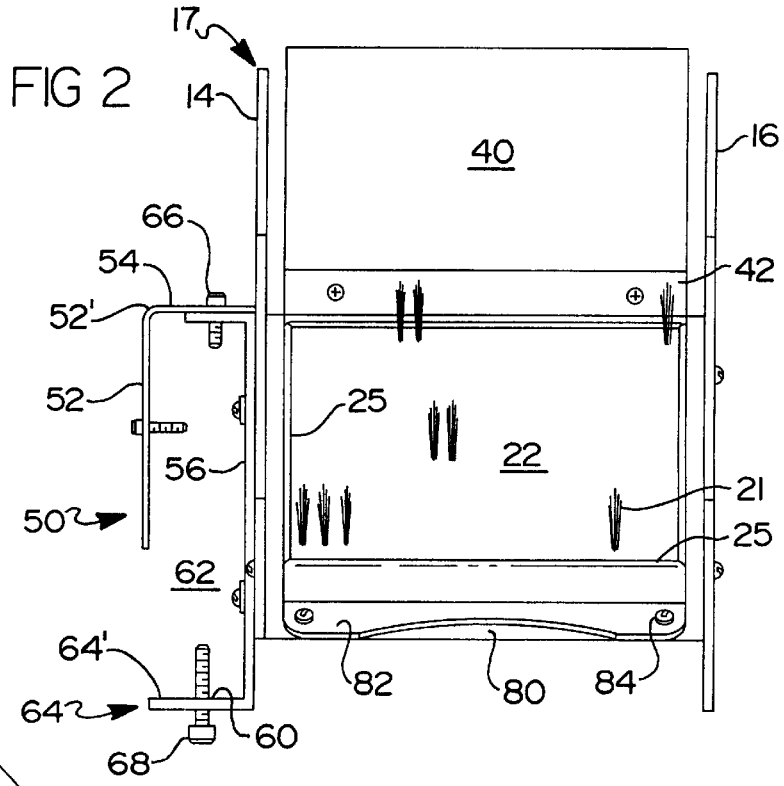
FIG. 2 is a front elevational view of the spike cleaner shown in FIG. 1.
Figure 3:
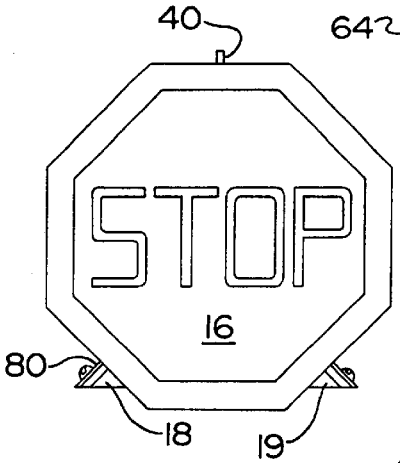
FIG. 3 is a side elevational view of the spike cleaner shown in FIG. 1.

With more particularity, and with reference to the Drawings, and in accordance with the present invention, there is provided a golf shoe spike cleaner in accordance herewith and, generally, denoted at 10.

The spike cleaner 10 comprises a frame 12, and a pair of spaced apart sidewalls 14 and 16, which comprise substantially planar members. As is shown in the drawing each sidewall 14 and 16 has, respectively, an interior surface 14' and 16' and an exterior surface 14" and 16". A space 17 is defined between the interior surfaces 14' and 16' of the sidewalls.

As shown in the drawing the sidewall 16 is octagonal shaped to simulate a traffic "stop sign". Such a configuration enhances the utility of the device hereof by providing a traffic signal to an approaching cart. Of course, other geometric configurations and patterns may be provided for the sidewall(s). For example, the sidewall 16 may be configured as a triangle to simulate a "yield sign", rounded to simulate a golf ball or other conventional standard traffic signal or any other convenient configuration.

The frame 12 defines a base 18 from which the sidewalls 14 and 16 upwardly extend. The base 18 comprises a pair of spaced apart base plates 19 and 19' which comprise substantially planar members. Preferably, a mounting plate 80 overlies the edges of the plates 19 and 19' and is secured thereto by gluing, bonding or the like. As shown, the plate 80 spans the space 17 and is angularly inclined with respect to the ground at an angle of about 45 degrees. Superposed on the mounting plate 80 is a support plate 82 which is secured to the mounting plate 80 by any suitable means, such as fasteners 84.

The sidewalls 14 and 16 are secured to the base plates 19 and 19', respectively, by any convenient means, such as through threaded fasteners 21 or the like. Similarly, the frame 12 may be integrally formed as a unitary member and may be formed from any suitable material such as plastic, metal or the like.

Preferably, and according to this invention, a grommet, bushing, bumper or cushion member or the like, such as shown at 70, may be interposed, respectively, between the sidewalls 14 and 16 and the base plates 19 and 19'. Provision of a cushion-like member 70 advantageously operates to absorb any forces or impact received by the sidewalls.

A spike cleaner 20 traverses substantially the width of the space 17 between the interior surfaces 14' and 16' of the sidewalls 14 and 16, respectively. The spike cleaner 20 generally comprises a rigid mounting block 24 or rigid base member and a stiff brush 22 of the type well known and commercially available and which is of the type typically used for the cleaning of golf shoe spikes. The brush 22 comprises a plurality of bristles 23 which are secured to the mounting block 24 by any conventional manner and project upwardly from the block 24. The mounting block 24 is secured to the support plate 82 by fasteners 86 or by other conventional methods.

The brush 22 is disposed in the space 17 and as a result of its securement to the mounting plate 80 is angularly inclined with respect to the base at an angle of about 45 degrees. The brush 22 is disposed at an angle in order to achieve a convenient angle for the golfer to drag the spikes of the shoes against the bristles 23. The angle can be chosen for convenience, but, as noted, is preferably about 45 degrees.

Figure 5:
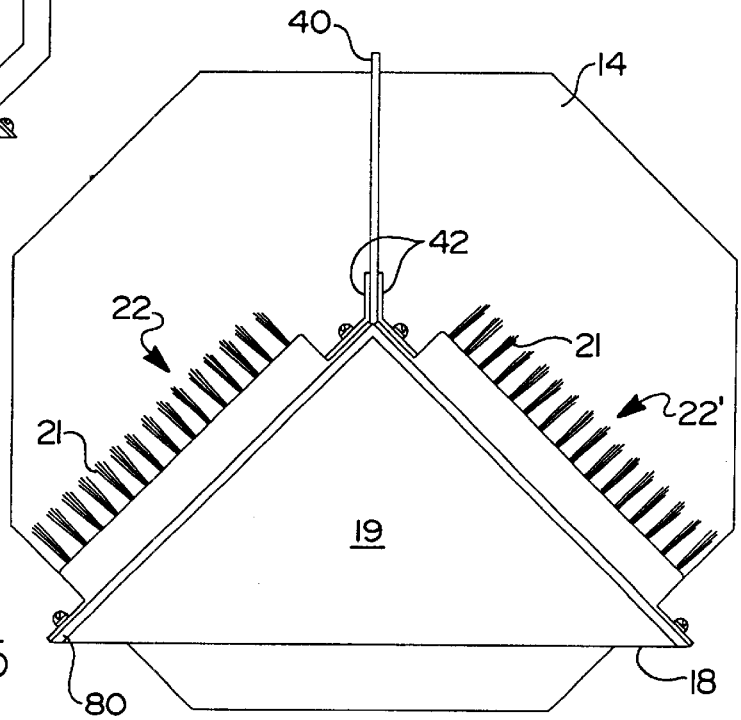
FIG. 5 is a cross-sectional view taken along line 5—5 of FIG. 4.
Figure 6:
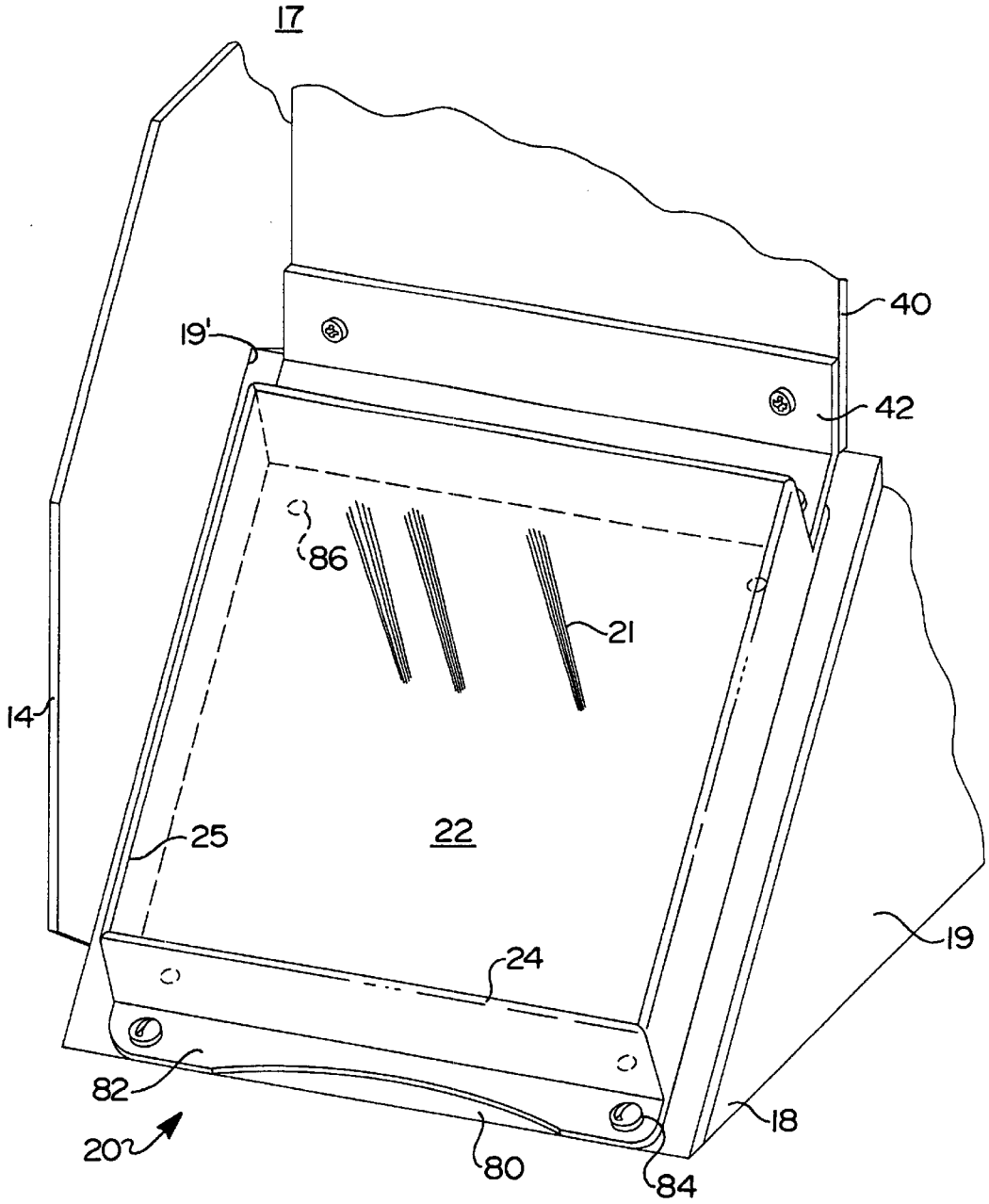
FIG. 6 is a perspective view of the spike cleaner shown in FIG. 1 with parts removed to show detail.

As shown in the Drawings, and referring to FIG. 5 in particular, preferably, a pair of brushes 22 and 22' are mounted in opposition to each other in the space 17 defined between the interior surfaces 14' and 16' of the sidewalls 14 and 16. Each of the brushes 22 and 22' is, preferably, identical.

In providing the pair of opposed brushes 22 and 22', a mounting frame 25 is secured to and surrounds the mounting block 24. Similarly, a mounting frame 25' is secured to and surrounds the corresponding mounting block 24'. The mounting block 24, mounting frame 25 and brushes 22 constitute a unit which is, thus, affixed to the support plate 82.

It should be noted that the combined frame and brush may define a single replaceable assembly in lieu of the brush, alone.

Preferably, a shield 40 is disposed in the interior space 17 between the sidewalls 14 and 16 and projects upwardly from its connection to a U-shaped bracket 42. As shown, the bracket 42 comprises a pair of legs 42' and 42" formed, respectively, as extensions of the support plates 82 and 82'. The shield 40 is sandwiched between the legs 42' and 42" and secured to the bracket 42 by any suitable means, such as shown by the fasteners 43. As with the brushes 22 and 22', the shield 40 spans or traverses the width or space between the interior surfaces 14' and 16' of the respective sidewalls 14 and 16. The shield 40 projects upwardly from its securement and above the upper plane of the sidewalls 14 and 16.

The shield 40 prevents any debris removed from the spikes from scattering and strewing not only into the cart to which the spike cleaner 10 is affixed but, also, confines the debris to the area about the associated brush. It is to be appreciated that the shield 40 and the frame 12 cooperate to separate the frame 12 into a pair of mirrored compartments each of which contains a brush 22 or 22'. These compartments confine the debris removed from the spikes.

Preferably and according to an important aspect of this invention, the golf spike cleaner includes means for mounting the spike cleaner 10 to a golf cart or the like. To this end, a mounting bracket 50 is provided.

In a particularly preferred embodiment the mounting bracket 50 comprises a substantially J-shaped member having a first leg 52 having a first end 52' free and a second end 52", a second leg 54 normal to the second end 52", and a third leg 56 parallel to but longer than the first leg 52. The third leg 56 is secured to the exterior surface 14" of the sidewall 14 by any suitable means, such as bolts, fasteners, welding or the like.

Preferably, the mounting bracket 50 includes a fourth leg or plate 60 which extends substantially normal to the third leg 56 to a free end 60' and is parallel to the second leg 54. Thus, a gap 62 is defined between the free ends 52' and 60', respectively, to the first and fourth legs 52 and 60. This gap 62 is of sufficient width to enable the mounting bracket 50 to fit around the rear bumper of a golf cart (not shown).

As shown in FIGS. 1 AND 4, the first, second and fourth legs 52, 54 and 60 each carry at least one fastener, or the like. Herein fasteners 66, 67 and 68 are shown.

The fasteners 66, 67 and 68 threadably engage the body of the cart about the bumper thereof to removably mount the device 10 hereof to the golf cart. Threadable advance of the fasteners 66, 67 and 68 relative to their respective legs 52, 54 and 60 enable the mounting bracket 50 to be adjusted and tightened about the golf cart. The fasteners 66 and 68 are disposed vertically and adjust the vertical grip on the bumper. The fastener 67 is disposed horizontally to adjust, the horizontal grip on the bumper. It is to be appreciated that other bracketry may be used to mount the spike cleaner hereof to the golf card, other than the specific bracket depicted herein.

In use, the bracket 50 is used to affix the spike cleaner 10 to the rear bumper of the golf cart, preferably, substantially medially thereof. Thus, where there are two golf bags seated in the rear well of the golf cart, the spike cleaner hereof is disposed intermediate or between the two. Of course, if the golf cart has a front bumper the present device may be affixed thereto. When affixed to the golf cart the brushes are disposed outwardly and are approached, for cleaning spikes, laterally. By providing a pair of brushes, no awkwardness in maneuverability is needed to clean both shoes.

It is to be appreciated from the preceding that there has been described herein a golf shoe spike cleaner which, when mounted to a golf cart, enables a golfer to clean his or her spikes at any desired moment. It is further to be appreciated that with appropriate bracketry being associated therewith, in lieu of the mounting bracket described herein, the present device may also be used to accommodate hand pulled carts.

While the invention has been illustrated and described in detail in the drawings and the foregoing description, the same is to be considered as illustrative and not restrictive in character, it being understood that only the preferred embodiments have been shown and described fully and that all changes and modifications that come within the spirit of the invention are desired to be protected.

What is claimed is:

1. A golf spike cleaner particularly adapted for use in association with a golf cart, and which comprises:

a frame for mounting at least one spike cleaner thereto, the frame comprising a pair of spaced apart sidewalls extending upwardly to top surfaces and forming a cavity therebetween, at least one spike cleaner mounted to the frame, mounting means for mounting the spike cleaner in said cavity below said top surfaces, and a mounting bracket connected to the frame and configured for mounting the frame to said golf cart.

2. The golf shoe spike cleaner as recited in claim 1, wherein said spike cleaner comprises a brush, a brush plate configured as a generally planar member which is operable to support said brush so as to extend upwardly from a top surface thereof, and said mounting means comprises a pair of spaced apart base plates extending upwardly to top surfaces and a mounting plate secured to the top surfaces of said base plates, said base plates being disposed in said cavity and said mounting plate removably mounting the brush plate and orienting the brush to face upwardly from said mounting plate.

3. The golf spike cleaner as recited in claim 1, wherein said mounting bracket comprises a first and a second bracket member having legs formed in a manner to engage a bumper of said golf cart, said first bracket member having a first leg extending transversely to said frame and forming an inverted "J" in cross section to seat onto the bumper, and said first and second bracket members being vertically spaced and forming a vertical gap to fit about said bumper.

4. The golf shoe spike cleaner as recited in claim 1, wherein said spike cleaner comprises a brush plate having a brush extending therefrom, and said mounting means is adapted to mount a pair of spike cleaners thereto, said frame comprising a pair of mounting plates disposed in said cavity and extending between said sidewalls, said mounting plates being substantially perpendicular to said sidewalls and each disposed at an angle relative to the ground, and each said mounting plate being adapted to receive a brush plate and orient its respective brush to face upwardly.

5. The golf shoe spike cleaner as recited in claim 4, wherein said mounting plates are disposed at an angle of about 45° relative to the ground.

6. The golf shoe spike cleaner as recited in claim 4, further comprising a shield interposed between said mounting plates for shielding the brush plates from one another.

7. The golf shoe spike cleaner as recited in claim 6, wherein said shield comprises a sheet of material having first and second ends and extends substantially between the sidewalls, and further comprising a pair of support plates each having a free end, said support plates being mounted to a respective mounting plate such that said free ends are facing and define a vertically disposed channel sized to receive one end of said shield, and securement means for securing the shield in said channel such that the other end of said shield extends vertically from said channel.

8. The golf shoe spike cleaner as recited in claim 1, further comprising impact damping means operating between said sidewalls and said frame for absorbing loads transmitted to said sidewalls.

9. In combination, a golf cart having a bumper;

a brush for cleaning grass and dirt from the spikes of golf shoes; and mounting means for supporting the brush to the bumper in operable relation to permit a golfer to clean the spikes, said mounting means comprising a pair of sidewalls extending vertically in generally parallel spaced apart relation whereby to form cavity therebetween;

a frame disposed in the cavity, said frame including a pair of support plates extending between the sidewalls;

a pair of brush plates each configured as a generally planar member and including a brush on a top surface thereof, one said brush plate being disposed on a respective support plate with the brush facing upwardly; and bracket means for removably mounting said frame to said bumper.

10. The combination as claimed in claim 9, wherein said bracket means comprises a first bracket for engaging a first portion of said bumper;

a second bracket for engaging a second portion of said bumper;

said first and second portions being vertically spaced to form an opening for receiving said bumper; and tightening means operating between said brackets for tightening the grip of said brackets with said bumper.

11. The combination as claimed in claim 9, wherein each said support plate has a free end, the support plates being mounted to the frame at an acute angle to the ground and such that their free ends are facing one another and define a channel; and a shield is received in said channel in such manner as to divide the cavity and shield the brushes from one another.

12. A golf shoe spike cleaner which comprises a pair of sidewalls extending upwardly and forming a hollow cavity therebetween;

a pair of base plates extending upwardly in said cavity to first and second top edge portions, said edge portions being disposed at an acute angle to the ground;

fastening means connecting each base plate to one respective sidewall;

a pair of mounting plates extending extending transversely between said sidewalls, one said mounting plate being connected to said first top edge portions and the other mounting plate being connected to said second top edge portions, each said mounting plate being connected so as to have a top surface facing upwardly;

a pair of support plates mounted, respectively, to the top surface of one and the other said mounting plate, each said support plate having a free end portion and mounted so that the free end portions are facing and define a channel;

a shield secured in said channel;

a pair of brush plate units; and mounting means for removably mounting a respective brush plate unit in operable relation with a respective support plate with each said brush plate unit being protected from the other by said shield.

13. The golf shoe spike cleaner as claimed in claim 12, further comprising attachment means for attaching at least one said base plate to a support structure, said attachment means including a first bracket member disposed vertically above a second bracket member by an amount sufficient to seat about said support structure; and tightening means for advancing the brackets together and into tight gripping relation with the support structure.

14. The golf shoe spike cleaner as claimed in claim 12, wherein said fastening means comprises threaded fasteners; and impact damping means for reducing impact forces transmitted from the sidewalls to the base plates.

15. The golf shoe spike cleaner as claimed in claim 14, wherein said impact damping means comprises at least one cushion member operating between the sidewalls and base plates.

* * * * *